US006098403A

United States Patent [19]

Wilke

[11] Patent Number: 6,098,403

[45] **Date of Patent: *Aug. 8, 2000**

[54] HYDRAULIC CONTROL VALVE SYSTEM WITH PRESSURE COMPENSATOR

[75] Inventor: Raud A. Wilke, Dousman, Wis.

[73] Assignee: Husco International, Inc., Waukesha, Wis.

[ * ] Notice: This patent is subject to a terminal disclaimer.

[21] Appl. No.: 09/270,692

[22] Filed: Mar. 17, 1999

[51] Int. Cl.[7] ..... F15B 13/08

[52] U.S. Cl. ..... 60/427; 60/452; 137/596.13; 137/625.68

[58] Field of Search ..... 60/427, 452; 137/596.13, 137/625.68

[56] References Cited

U.S. PATENT DOCUMENTS 5,067,389 11/1991 St. Germain ..... 91/446
5,579,642 12/1996 Wilke et al. ..... 60/426
5,715,865 2/1998 Wilke ..... 137/596
5,791,142 8/1998 Layne et al. ..... 60/450
5,890,362 4/1999 Wilke ..... 60/427

*Primary Examiner*—Gerald A. Michalsky
*Attorney, Agent, or Firm*—Quarles & Brady LLP; George E. Haas

[57] ABSTRACT

An improved pressure-compensated hydraulic system includes a separate valve section which feeds hydraulic fluid from a variable displacement pump to one of several hydraulic actuators. Each valve section has a main valve spool and a pressure compensating poppet. The main valve spool has a metering orifice that controls the flow of fluid to the actuator. The poppets in the valve sections collectively apply a pressure to the pump pressure control input which is a function of the greatest to a load pressure among the hydraulic actuators.

8 Claims, 2 Drawing Sheets

HYDRAULIC CONTROL VALVE SYSTEM WITH PRESSURE COMPENSATOR

FIELD OF THE INVENTION

The present invention relates to valve assemblies which control hydraulically powered machinery; and more particularly to pressure compensated valves wherein a fixed differential pressure is to be maintained to achieve a uniform flow rate.

BACKGROUND OF THE INVENTION

The speed of a hydraulically driven working member on a machine depends upon the cross-sectional area of principal narrowed orifices of the hydraulic system and the pressure drop across those orifices. To facilitate control, pressure compensating hydraulic control systems have been designed to set and maintain the pressure drop. These previous control systems include sense lines which transmit the pressure at the valve workports to the input of a variable displacement hydraulic pump which supplies pressurized hydraulic fluid in the system. The resulting self-adjustment of the pump output provides an approximately constant pressure drop across a control orifice whose cross-sectional area can be controlled by the machine operator. This facilitates control because, with the pressure drop held constant, the speed of movement of the working member is determined only by the cross sectional area of the orifice. One such system is disclosed in U.S. Pat. No. 4,693,272 entitled "Post Pressure Compensated Unitary Hydraulic Valve", the disclosure of which is incorporated herein by reference.

Because the control valves and hydraulic pump in such a system normally are not immediately adjacent to each other, the changing load pressure information must be transmitted to the remote pump input through hoses or other conduits which can be relatively long. Some hydraulic fluid tends to drain out of these conduits while the machine is in a stopped, neutral state. When the operator again calls for motion, these conduits must refill before the pressure compensation system can be fully effective. Due to the length of these conduits, the response of the pump may lag, and a slight dipping of the loads can occur, which characteristics may be referred to as the "lag time" and "start-up dipping" problems.

In some types of hydraulic systems, the "bottoming out" of a piston driving a load could cause the entire system to "hang up". This could occur in such systems which used the greatest of the workport pressures to motivate the pressure compensation system. In that case, the bottomed out load has the greatest workport pressure and the pump is unable to provide a greater pressure; thus there would no longer be a pressure drop across the control orifice. As a remedy, such systems may include a pressure relief valve in a load sensing circuit of the hydraulic control system. In the bottomed out situation, the relief valve opens to drop the sensed pressure to the load sense relief pressure, enabling the pump to provide a pressure drop across the control orifice.

While this solution is effective, it may have an undesirable side effect in systems which use a pressure compensating check valve as part of the means of holding substantially constant the pressure drop across the control orifice. The pressure relief valve could open even when no piston was bottomed out if a workport pressure exceeded the set-point of the load sense relief valve. In that case, some fluid could flow from the workport backwards through the pressure compensating check valve into the pump chamber. As a result, the load could dip, which condition may be referred to as a "backflow" problem.

Another drawback of previous pressure compensating hydraulic control systems is the large number of components. For example the system described in U.S. Pat. No. 5,579,642 provides a chain of shuttle valves which sense the pressure at every powered workport of each valve section. The output pressure of that chain is applied to an isolator valve which connects the control input of the pump to either the pump output or to the tank depending upon the sensed workport pressure. It is desirable to simplify the structure of the pressure compensating hydraulic control system and reduce manufacturing complexity.

SUMMARY OF THE INVENTION

The present invention is directed toward satisfying those needs.

A hydraulic valve assembly for supplying hydraulic fluid to multiple actuators includes a pump that produces a variable output pressure which at any time is the sum of input pressure at a pump control input and a constant margin pressure. A separate valve section has a variable metering orifice that controls the flow of hydraulic fluid from the pump to one of the actuators and is subjected to a load force exerted on that actuator which creates a hydraulic load pressure. The valve sections are of a type in which the greatest hydraulic load pressure controls the pressure that is applied to the pump control input.

Each valve section incorporates a poppet which is slidably located in a control bore, thereby defining first and second chambers in the control bore on opposite sides of the poppet. The first chamber communicates with the metering orifice and the second chamber connects to the control input of the pump. The control bore has an inlet that receives a pressure which is dependent upon the output pressure of the pump. A spring tends to bias the poppet to open a path between the inlet and the second chamber. Movement of the poppet within the bore controls flow of hydraulic fluid between the inlet and the second chamber.

DETAILED DESCRIPTION OF THE INVENTION

Figure 1:
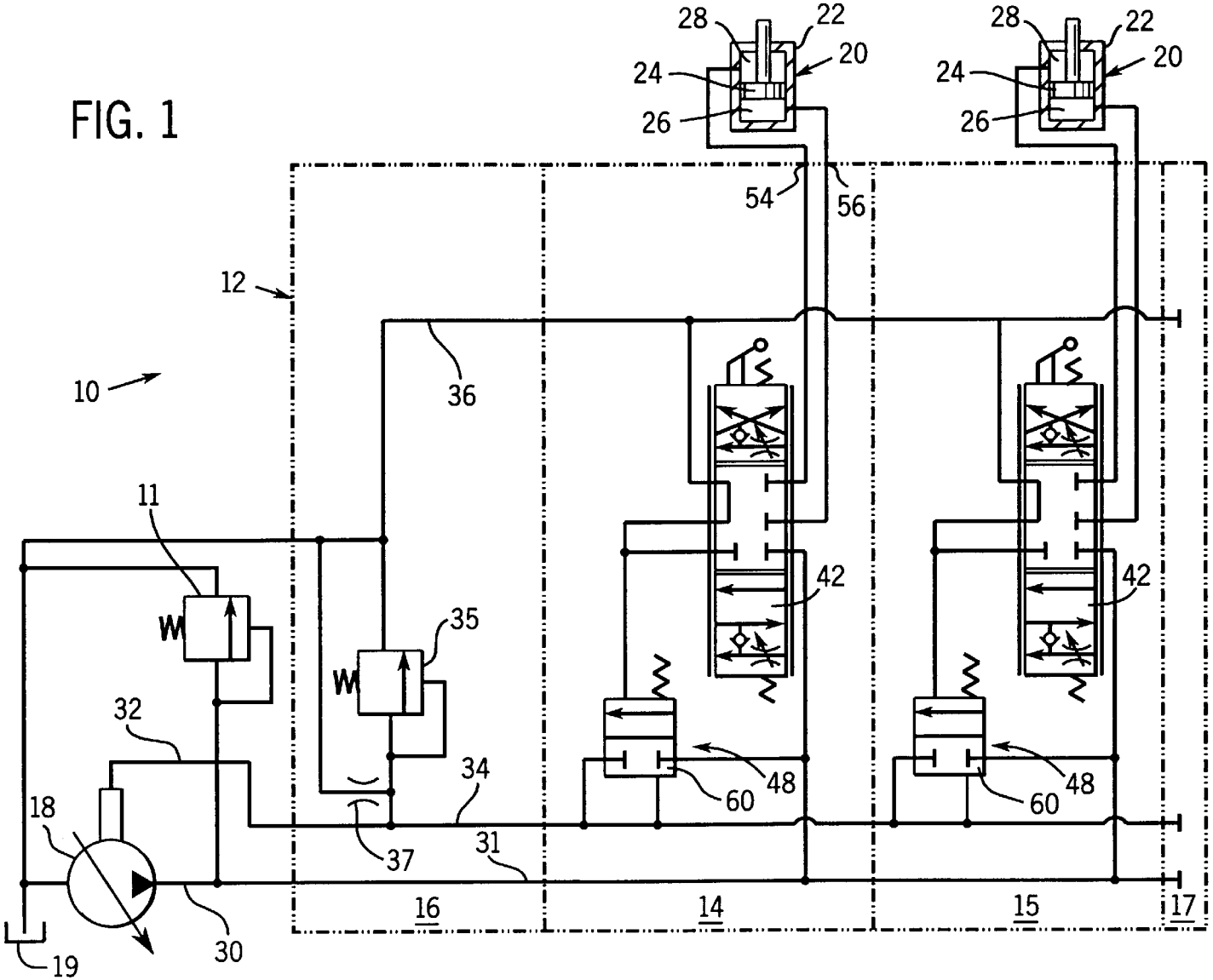
FIG. 1 a schematic diagram of a hydraulic system with a multiple valve assembly which incorporates the present invention.

FIG. 1 schematically depicts a hydraulic system 10 having a multiple valve assembly 12 which controls motion of hydraulically powered working members of a machine, such as the boom and bucket of a backhoe. The physical structure of the valve assembly 12 comprises several individual valve sections 14 and 15 interconnected side-by-side between two end sections 16 and 17. A given valve section 14 or 15 controls the flow of hydraulic fluid from a pump 18 to one of several actuators 20 connected to the working members and controls the return of the fluid to a reservoir or tank 19. The output of pump 18 is protected by a pressure relief valve 11. Each actuator 20 has a cylinder housing 22 containing a piston 24 that divides the housing interior into a bottom chamber 26 and a top chamber 28. Reference herein to directional movement and relationships, such as top and bottom or up and down, refer to the relationship and movement of the components in the orientation illustrated in the drawings, which may not be the orientation of the components as attached to a working member on the machine.

The pump 18 typically is located remotely from the valve assembly 12 and is connected by a supply conduit or hose 30 to a supply passage 31 extending through the valve assembly 12. The pump 18 is a variable displacement type whose output pressure is designed to be the sum of the pressure at a displacement control port 32 plus a constant pressure, known as the "margin." The control port 32 is connected to a passage 34 that extends through the sections 14 and 15 of the valve assembly 12. A reservoir passage 36 also extends through the valve assembly 12 and is coupled to the tank 19. End section 16 of the valve assembly 12 contains ports for connecting the supply passage 31 to the pump 18, the reservoir passage 36 to the tank 19 and the load sense passage 34 to the control port 32 of pump 18. That end section 16 also includes a pressure relief valve 35 that relieves excessive pressure in the load sense passage 34 to the tank 19. An orifice 37 provides a flow path between the load sense passage 34 and the tank 19, the function of which will be described subsequently.

To facilitate understanding of the invention claimed herein, it is useful to describe basic fluid flow paths with respect to one of the valve sections 14 in the illustrated embodiment. The other valve section 15 operates in an identical manner and the following description is applicable it as well.

Figure 2:
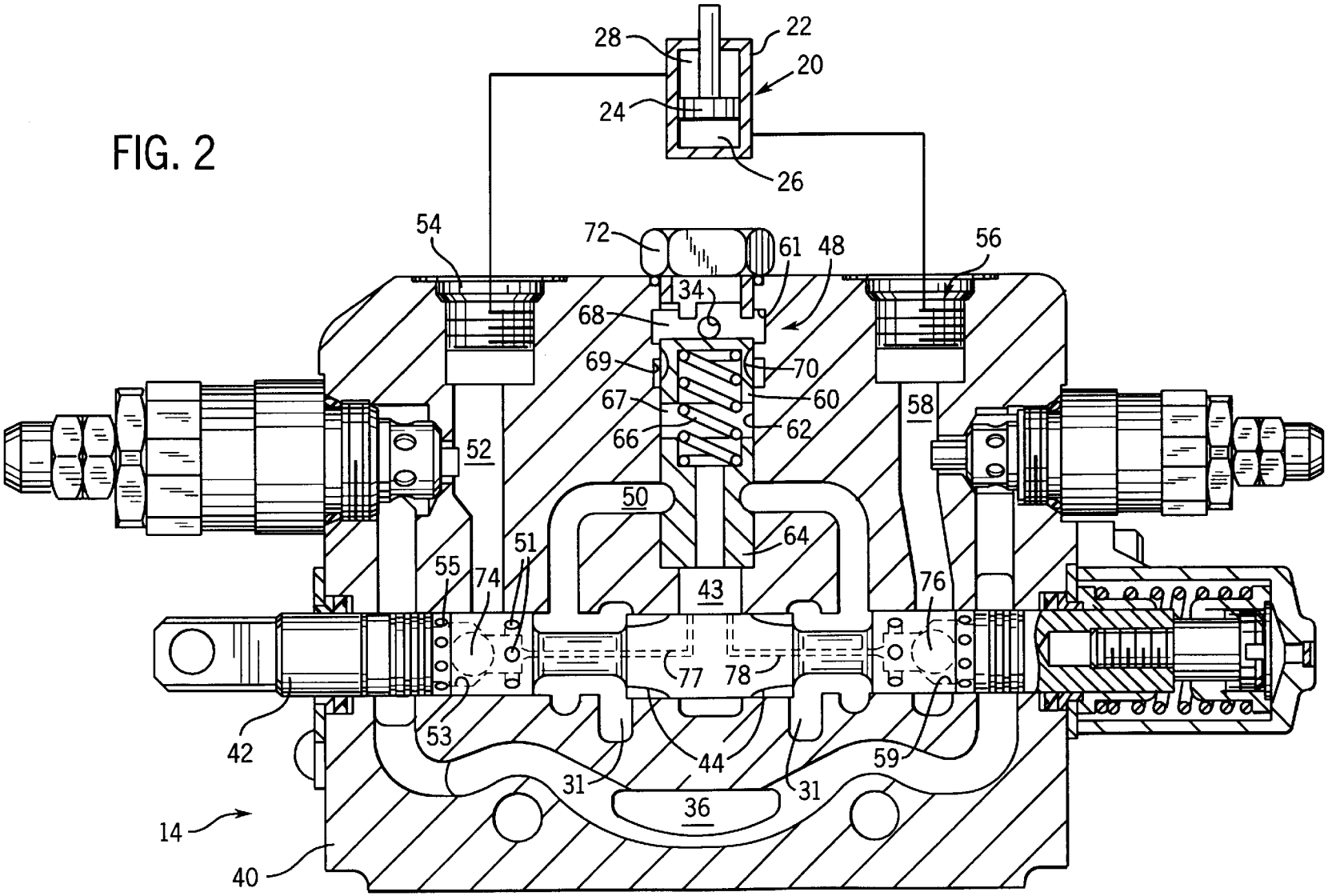
FIG. 2 is a cross sectional view through one section of the multiple valve assembly and schematically shows connection to a hydraulic cylinder.

With additional reference to FIG. 2, valve section 14 has a body 40 and control spool 42 which a machine operator can move in reciprocal directions within a spool bore 41 in the body by operating a control member (not shown) attached thereto. Depending on which direction that the control spool 42 is moved, hydraulic fluid is directed to the bottom or top chamber 26 or 28 of a cylinder housing 22 thereby driving the piston 24 up or down, respectively. The extent to which the machine operator moves control spool 42 determines the speed of the piston 24, and thus that of a working member connected to the piston.

To lower the piston 24, the machine operator moves the control spool 42 rightward into the position illustrated in FIG. 2. This opens passages which allow the pump 18 (under the control of the load sensing network to be described later) to draw hydraulic fluid from the tank 19 and force the fluid through pump output conduit 30, into a supply passage 31 in the body 40. From the supply passage 31 the hydraulic fluid passes through a metering orifice formed by a set of notches 44 of the control spool 42 to a bridge passage 50. The hydraulic fluid travels through a bridge passage 50 and a passageway in the control spool 42, formed by apertures 51 and 55 and an internal channel 53, to workport passage 52, connected to workport 54 and the upper cylinder chamber 28. The pressure thus transmitted to the top of the piston 24 causes it to move downward, thereby forcing hydraulic fluid out of the bottom chamber 26 of the cylinder housing 22. This exiting hydraulic fluid flows into another valve assembly workport 56, through the workport passage 58 and the control spool 42 via internal channel 59 to the reservoir passage 36 that is coupled to the tank 19.

To move piston 24 upward, a machine operator moves control spool 42 to the left. That action opens a corresponding set of passages so that the pump 18 forces hydraulic fluid into the bottom cylinder chamber 26, and pushes fluid out of the top chamber 28 thereby causing piston 24 to move upward.

The present invention relates to a mechanism for sensing the greatest hydraulic load pressure among the multiple valve sections in order to provide a load sense pressure which controls the pump 18. With reference to FIGS. 1 and 2, the load sense mechanism 48 has a poppet 60 which sealing slides reciprocally in a control bore 62 of the valve body 40. A stationary insert 64 rests against a shoulder deep within the control bore 62 and defines an first chamber 67 with respect to the poppet 60. A spring 66 in the first chamber 67 biases the poppet 60 outward in the control bore, away from the stationary insert 64. The stationary insert 64 has an aperture therethrough which communicates the pressure in a feeder passage 43 to the first chamber 67 and thus to the underside of poppet 60.

The poppet 60 also defines a second chamber 68 on the opposite side from the stationary insert 64, as seen in FIG. 2. The load sense passage 34, connected to the pump control port 32, opens into this second control bore chamber. Chamber 68 has a slightly larger diameter than the main section of the bore 62. An annular recess in the bore 62 is spaced inwardly from second chamber 68 and communicates with the supply passage 31 from the pump outlet. The poppet 60 of the load sense mechanism 48 has an annular recess 70 in the exterior surface, which provides a passageway between a portion of the supply passage 31 and the load sense passage 34 when the poppet is pushed upward in the bore 62 against the plug 72.

FIG. 2 illustrates the position of the valve section 14 with the control spool 42 in the neutral (i.e. centered) position. In that situation, the metering orifice of valve section is closed so that the supply passage 31 does not communicate with feeder passage 43 and first chamber 67 and thus does not act on the poppet 60. Therefore, the poppet 60 is forced against bore end wall 61 by spring 66 closing communication between the pump supply recess 69 and the load sense passage 34. If the poppets 60 in all the valve sections are closed, the fluid within the load sense passage 34 bleeds through the relief orifice 37 in the end plate 16, shown in FIG. 1, until the load sense pressure equals the tank pressure.

With continuing reference to FIG. 2, when the user moves the spool 42 to supply hydraulic fluid to one of the workports 54 or 56, the apertures 51 and 55 of the internal spool channel 53 align with the bridge 50 and the passage 52 or 58 for the workport to be powered. Each internal spool channel 53 and 59 has a check valve 74 and 76, respectively, that opens when the bridge pressure exceeds the associated workport pressure. Thus at this time, hydraulic fluid flows through this route to the selected workport. The check valve 74 and 76 prevent hydraulic fluid from being forced backwards through the valve section 14 from a workport 54 or 56 t o the pump 18 when workport pressure is greater than the supply pressure in feeder passage 43. This effect, commonly referred to as "craning" in off-highway equipment, happens when a heavy load is applied to the associated actuator 20. When this occurs, the excessive load pressure appears at the powered workport 54 or 56 and is communicated into the associated internal spool chamber 53 or 59 and check valve 74 or 76. Because this workport pressure is greater than that in the feeder passage 43, the check valve 74 or 76 closes internal spool chamber 53 or 59 to reverse fluid flow back to toward the pump. The craning condition can be terminated by reversing the process that created it, e.g. removing the excessive load on the actuator.

While this is occurring and pump pressure in supply passage 31 is applied through a notch 44 in the control spool 42 to the feeder passage 43 and thereby to the first chamber 67 on one side of the poppet 60. When the operator initially opens the spool valve, the pump pressure is below that of the workport to be powered and the associated check valve 74 or 76 is closed. Therefore, the feeder passage 43 will be at the pump pressure which move holds the poppet 60 in the raised position which applies the pump pressure to the load sense passage 34. This applies pressure to the control input of the pump 18 which results in the pump output pressure increasing.

Eventually the pump pressure will exceed the pressure at the workport 54 or 56 to be powered which results in the opening of the check valve 74 or 76 associated with that workport. When this occurs the hydraulic fluid flows from the bridge 50 through the internal spool channel 53 or 59 to that workport 54 or 56. At the same time, the pump pressure being applied to the feeder passage 43 and first chamber 67 is held at the present level due to communication through a transfer channel 77 or 78 in the central section of spool 42 to the respective internal spool channel 53 or 59.

Soon thereafter the pressure in the load sense passage 34 rises above the pressure in the first chamber 67 due to continued communication between the pump supply recess 69 and the load sense passage. That pressure relationship causes the poppet 60 to move downward away from the plug 72 thereby closing that communication. This holds the pump control signal at the current level thus maintaining the output pressure of the pump.

Should the pressure at the powered workport again rise above the pump output pressure, the associated check valve 74 or 76 will close allowing the pump pressure through spool notches 44 to increase the pressure in the first chamber 67. Eventually the cavity pressure will exceed the pressure in the load sense passage 34 which moves the poppet to open communication between the pump supply recess 69 and the load sense passage and increase the pump control signal.

The discussion thus far related to a single section 14 of the valve assembly in isolation from the other section 15. It will be understood that when the other valve section 15 has a workport pressure that exceeds the workport pressure on section 14, the pressure in the load sense passage 34 always will be greater that the pressure in first chamber 67 of valve section 14. Therefore the poppet will be forced closed by that greater load sense pressure and valve section 14 will have no affect on the pump control.

I claim:

1. In a hydraulic system having an array of valve sections or controlling flow of hydraulic fluid from a pump to a plurality of actuators, the pump produces an output pressure that is a function of pressure at a control input, and each valve section having a workport to which one of the plurality of actuators connects and having a spool with a metering orifice that is variable to regulate flow of the hydraulic fluid from the pump to the one actuator; the improvement comprising:

each valve section having a poppet slidably located in a bore thereby defining first and second chambers on opposite sides of the poppet, the first chamber communicating with the metering orifice and the second chamber connected to the control input of the pump, the bore having an inlet that receives a pressure which is dependent upon the output pressure of the pump, a spring biasing the poppet to open a path between the inlet and the second chamber; and wherein movement of the poppet within the bore controls flow of hydraulic fluid between the inlet and the second chamber.

2. The hydraulic system as recited in claim 1 further comprising a bleed orifice connecting the control input of the pump to a fluid reservoir for the pump.

3. The hydraulic system as recited in claim 1 wherein the poppet has a tubular portion with an open end facing the first chamber and within which the spring is received.

4. The hydraulic system as recited in claim 1 wherein the poppet has a exterior surface in which a channel is located to provide a passage for fluid to flow between the inlet and the second chamber when the poppet is in a given position within the bore.

5. A hydraulic valve assembly for controlling flow of hydraulic fluid from a pump to an actuator and from the actuator to a reservoir, the pump produces an output pressure that is a function of pressure at a control input; the hydraulic valve assembly comprising:

a body having a spool bore, a supply passage adapted to receive fluid from the pump, a reservoir passage to disperse fluid to the reservoir, a feeder passage, a first workport and second workport passages for connection to the actuator, wherein the supply, reservoir, feeder, and first and second workport passages intersect the spool passage, and a bridge passage that intersects the spool passage at two locations;

a spool bidirectionally slidable in the spool bore between a neutral position and a plurality of load-powering positions, the spool having first and second end sections each with an axially extending channel therein, first and second radial grooves spaced apart axially to define a land therebetween, a first transfer channel extending between the channel in the first end section and the land and, a second transfer channel extending between the channel in the second end section and the land;

wherein the spool has a first load-powering position in which the second radial groove provides a path between the supply passage and the bridge passage, the channel in the first end section provides a path between the bridge passage and the first workport passage, the first transfer channel communicates with the feeder passage, and the channel in the second end section provides a path between the second workport passage and the reservoir passage;

wherein the spool has a second load-powering position in which the first radial groove provides a path between the supply passage and the bridge passage, the channel in the second end section provides a path between the bridge passage and the second workport passage, and the second transfer channel communicates with the feeder passage, and the channel in the first end section provides a path between the first workport passage and the reservoir passage; and a poppet slidably in the feeder passage thereby defining a first chamber in communication with the spool bore and a second chamber which communicates with the control input of the pump, the feeder passage having a port that receives a pressure which is dependent upon the output pressure of the pump, and movement of the poppet controls flow of hydraulic fluid between the inlet and the second chamber.

6. The hydraulic system as recited in claim 5 further comprising a spring which biases the poppet to open a path between the inlet and the second chamber.

7. The hydraulic system as recited in claim 6 wherein the poppet has a tubular portion with an open end facing the first chamber and within which the spring is received.

8. The hydraulic system as recited in claim 5 further comprising:

a first check valve in the channel of the first end section which, in the first load-powering position, permits fluid flow only when pressure in the supply passage exceeds pressure in the first workport passage; and a second check valve in the channel of the second end section which, in the second load-powering position, permits fluid flow only when pressure in the supply passage exceeds pressure in the second workport passage.

* * * * *